US006678487B2

(12) United States Patent
Tashiro et al.

(10) Patent No.: US 6,678,487 B2
(45) Date of Patent: Jan. 13, 2004

(54) MAINFRAME STRUCTURE OF IMAGE FORMING APPARATUS

(75) Inventors: Susumu Tashiro, Hachioji (JP); Satoshi Hamaya, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/052,415

(22) Filed: Jan. 16, 2002

(65) Prior Publication Data

US 2002/0098008 A1 Jul. 25, 2002

(30) Foreign Application Priority Data

Jan. 22, 2001 (JP) ..... 2001-013036

(51) Int. Cl.[7] ..... G03G 15/00
(52) U.S. Cl. ..... 399/107
(58) Field of Search ..... 399/107, 108, 399/110; 347/108, 152, 263; 174/52.1; 361/728

(56) References Cited

U.S. PATENT DOCUMENTS 5,570,159 A * 10/1996 Hirose et al. ..... 399/107
6,259,872 B1 * 7/2001 Fukunaga et al. ..... 399/107
6,308,025 B1 * 10/2001 Okano et al. ..... 399/107
6,415,118 B1 * 7/2002 Setoriyama et al. .... 399/107 X
6,466,753 B2 * 10/2002 Kida ..... 399/107

* cited by examiner

*Primary Examiner*—Hoan Tran
(74) *Attorney, Agent, or Firm*—Muserlian, Lucas and Mercanti

(57) ABSTRACT

An image forming apparatus having an image forming unit that forms an image on an image bearing member, and a mainframe that firmly supports and positions the image bearing member and the image forming unit. The main frame has two side walls which are opposed to each other and substantially support the image bearing member and the image forming unit, a bottom wall to which the two side walls are rigidly connected, and a stay which is rigidly connected to the two side walls and is spaced away from the bottom wall. The bottom wall and the stay have a box type structure with an inner hollow room.

6 Claims, 8 Drawing Sheets

FIG. 6 ( a )
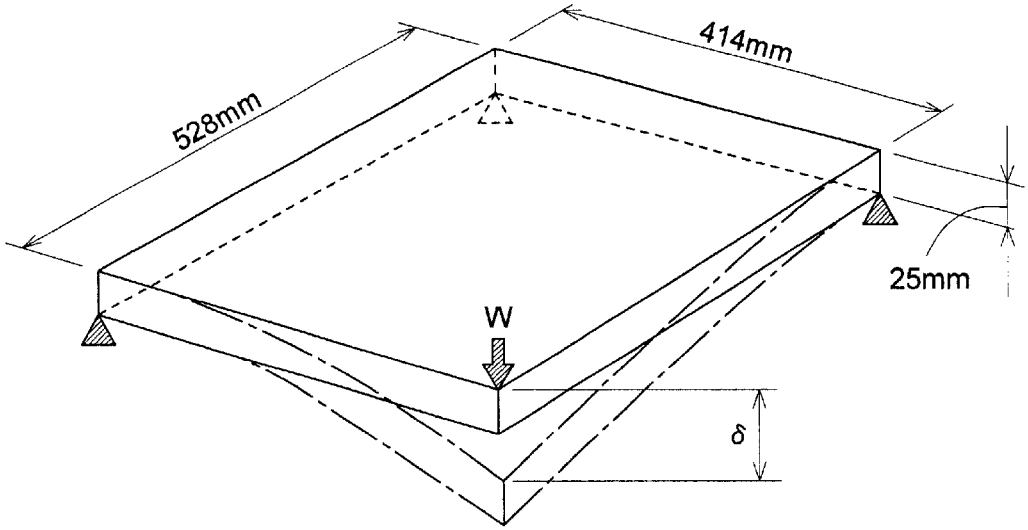
FIG. 6 ( b )
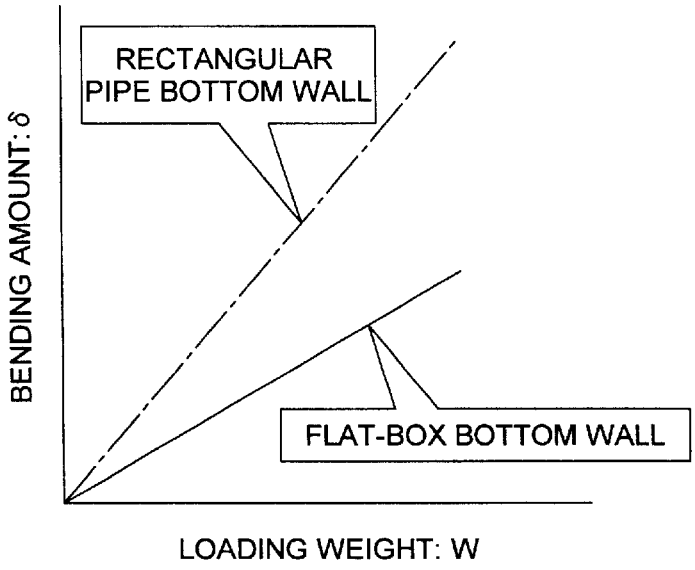

FIG. 9

| No. | TYPE OF STAY | BENDING AMOUNT: $\delta$ |
|---|---|---|
| ( 1 ) | FLAT-BOX STRUCTURE | 0.36mm |
| ( 2 ) | SINGLE PLATE | 0.63mm |
| ( 3 ) | NOT PROVIDED | 0.78mm |

MAINFRAME STRUCTURE OF IMAGE FORMING APPARATUS

BACKGROUND OF THE INVENTION

The present invention relates to an image forming apparatus, such as a copier, a printer, etc., and specifically relates to a structure of the mainframe with enhanced stiffness in the image forming apparatus.

In general, the mainframe in the image forming apparatus, is structured by two opposed vertical walls that are connected by a bottom wall and a plurality of stays. And each of the side walls, the bottom wall and the stays are structured with a single sheet of metal plate, or in necessity of high stiffness, with a rectangular pipe.

Recently, according with the requirement of high image quality, there is a tendency to structure the bottom wall support material with a rectangular pipe formed in quadrilateral shape, and under the bottom surface of the rectangular pipe are provided with casters. In this structure, there is a problem that the height of the apparatus increases excessively. In order to solve this problem, an image forming apparatus which applies flat rectangular pipes to decrease the thickness for restricting the height and maintaining the stiffness of the mainframe is disclosed in TOKKAIHEI No. 10-232525, etc.

However, even in the case of applying the flat rectangular pipe, when the apparatus is transported or moved, or affected by the flatness of the floor where the apparatus is installed, the deformation of the mainframe is concerned since the stiffness is not enough to maintain a required accuracy of the mainframe. As the result, in order to maintain the sufficient stiffness, large sized rectangular pipes need to be used, then, the height of the apparatus tends to be too large.

SUMMARY OF THE INVENTION

Overcoming the abovementioned problems in conventional image forming apparatus, it is an object of the present invention to provide an image forming apparatus, which is possible to form a high quality image by having higher stiffness than the apparatus applying the above mentioned rectangular pipes.

The object of the present invention can be achieved by the following structures.

(1) An image forming apparatus having a mainframe, which comprises two opposed vertical side walls connected to be unified with a bottom wall and at least one stay provided in the manner of leaving space from the bottom wall, wherein the bottom wall and said at least one stay are respectively have a hollow box-type structure.

(2) An image forming apparatus having a mainframe, which comprises two opposed vertical side walls connected to be unified with a bottom wall and at least one stay provided in the manner of leaving space from the bottom wall, wherein a caster for moving the image forming apparatus, is provided on the vertical side walls in such a manner that the top portion of the caster positions at higher level than the under surface of the bottom wall.

BRIEF DESCRIPTION OF THE DRAWINGS

FIG. 6(*a*) and FIG. 6(*b*) show explanatory illustration regarding the bending amount of the bottom wall (or bottom section).

FIG. 9 shows relations between the types of the intermediate stays and the bending amount.

DETAILED DESCRIPTION OF THE PREFERRED EMBODIMENT

Referring drawings, an embodiment of the present invention will be described in the following.

The scope of the present invention, however, is not limited to the following embodiment.

Figure 1:
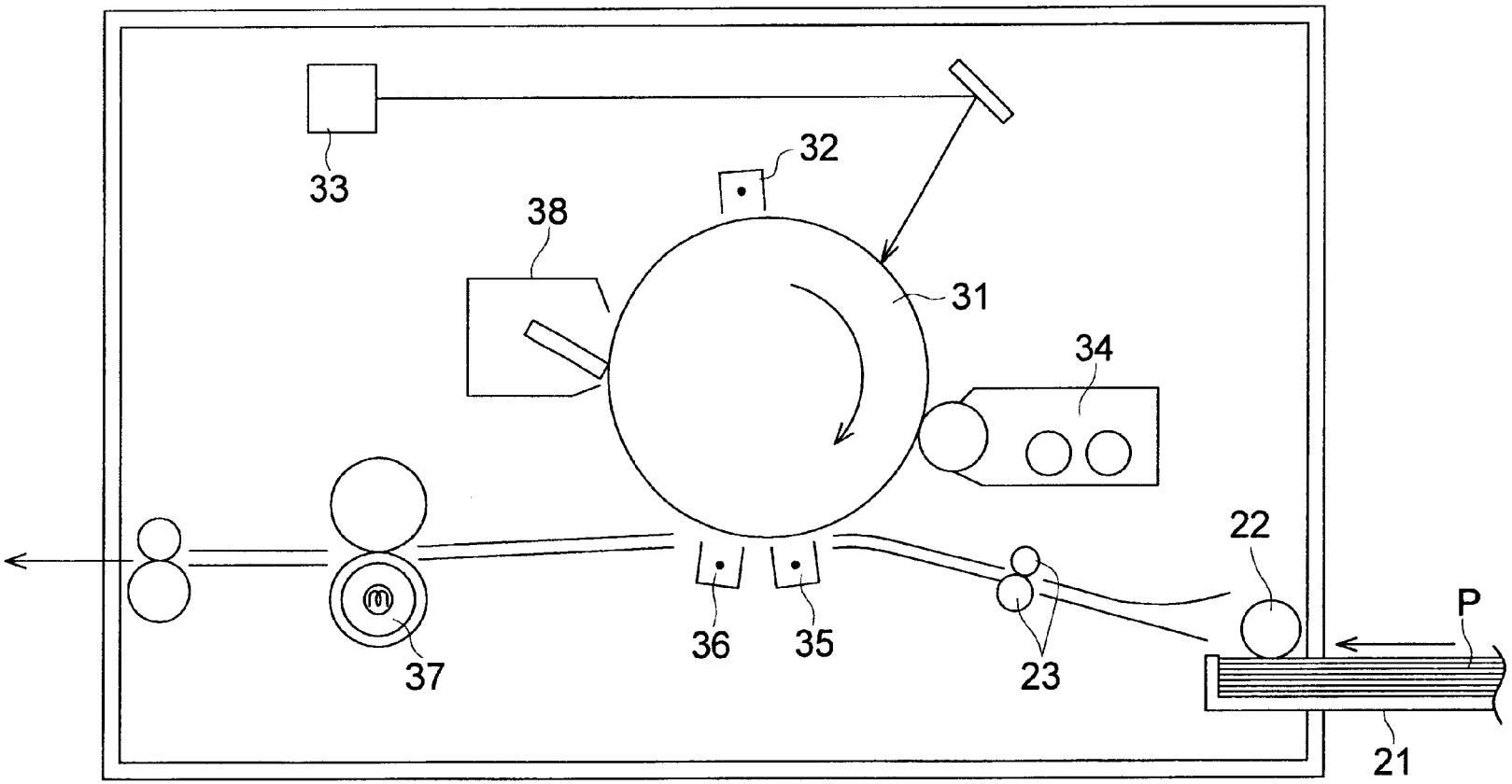
FIG. 1 shows a simplified cross-sectional view of a printer, representing an image forming apparatus.

FIG. 1 shows a simplified cross-sectional view of a printer, serving as an image forming apparatus embodied in the present invention. The printer comprises sheet-feeding cassette 21 for storing transfer sheets P, sheet-feeding roller 22 for taking out transfer sheet P one by one from sheet-feeding cassette 21 and resist roller 23 for conveying transfer sheet P, fed by sheet-feeding roller 22, to a transfer area. The photoreceptor drum 31 is driven to rotate in an arrow direction by controller means (not shown in the drawing). Charging means 32, exposing means 33, developing means 34, transferring means 35, separating means 36 and cleaning means 38 are arranged around the periphery of photoreceptor drum 31 in the above order from upstream. In this configuration, a toner image is formed on photoreceptor drum 31 through the processes of charging by charging means 32, exposing image by exposing means 33 (formation of a latent image), and developing by developing means 34, namely, a toner image is formed by development with toner. Then, the toner image is transferred onto transfer sheet P, conveyed by resist roller 23, by means of transferring means 35, and transfer sheet P is separated from photoreceptor drum 31 by means of separating means 36. A pair of rollers of fixing means 37 fixes the toner image onto transfer sheet P, separated from photoreceptor drum 31, with heat and pressure. While, after separating transfer sheet P, the surface of photoreceptor drum 31 is cleaned by cleaning means 38 to be ready for next image formation. Operations of each of the means 31–38, which structure the image forming means, is controlled by the controller.

Figure 2:
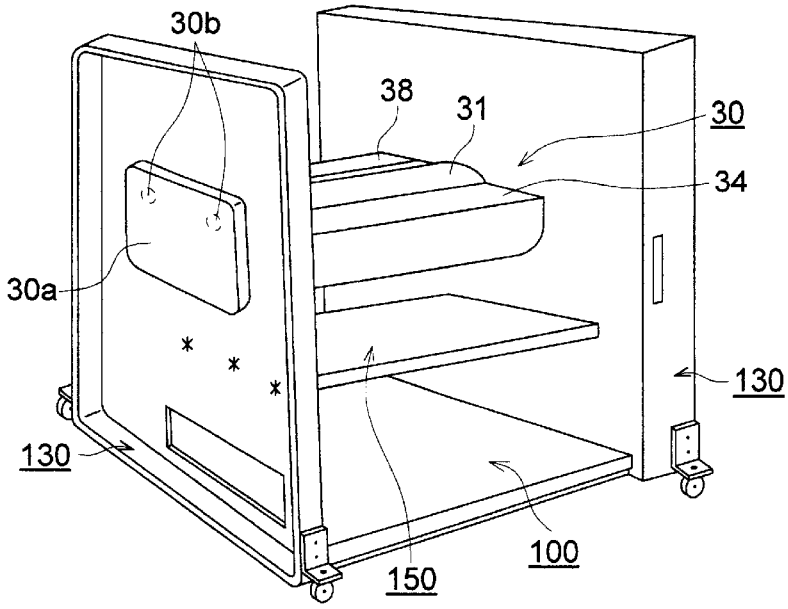
FIG. 2(*a*) and FIG. 2(*b*) show perspective views of the image forming apparatus mainframe, illustrating a positional relation between the photoreceptor drum and the mainframe.
Figure 2:
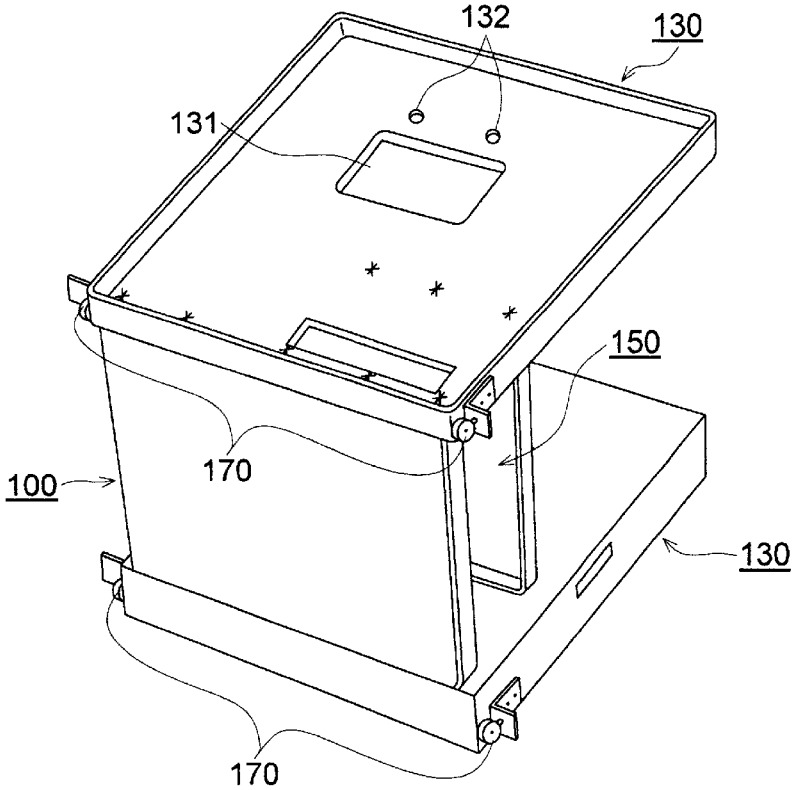

FIG. 2(*a*) and FIG. 2(*b*) show perspective views of the image forming apparatus mainframe, illustrating a positional relation between the photoreceptor drum and the mainframe. FIG. 2(*a*) shows a state where the drum cartridge 30 is installed in the apparatus mainframe. FIG. 2(*b*) is a perspective view of the apparatus mainframe seen from the direction of the bottom wall.

As shown in FIG. 2(*a*) and FIG. 2(*b*), the apparatus mainframe of the image forming apparatus has a unified structure of two vertical opposed side walls, a bottom wall and a stay which is provided in the manner of leaving space from the bottom wall.

In FIG. 2(*a*), the numeral 30 represents a drum cartridge, which holds and comprehensively includes photosensitive drum 31, developing means 34, and cleaning means 38. The numeral 100 represents the bottom wall in the mainframe of the image forming apparatus, the numeral 130 represents two opposed vertical side walls, which are connected to the bottom wall, and the numeral 150 represents the stay which reinforces the side walls, while in this embodiment only one stay is provided, a plurality of stays can be provided. The numeral 170 represent a caster, which is provided on the vertical side walls in such a manner that the top portion of the caster positions at higher level than the under surface of the bottom wall. As shown in the Figs., the vertical side walls are preferably formed in empty box-type by bending a peripheral edge area of a rectangular plate, since this structure enhances the stiffness with lightweight. Further, in this embodiment, side surfaces of the bottom walls 100 and the vertical side walls 130 are connected to structure the mainframe. As for the connecting method, although there is no particular limitation, and welding, adhesion by adhesives, etc. can be applicable, in cases where the mainframe is made of metal, connection by welding is preferable for reinforcing the stiffness.

By providing the caster 170 for moving the apparatus main body on the side wall 130, for example, other place than on the member forming the bottom wall 100 in such a manner that, the top portion of the caster positions at higher level than the under surface of the bottom wall 100, the bottom wall 100 can be lowered to the level just above contacting the floor, therefore, the height of the apparatus main body can be lowered than the case where a bottom wall is made with a rectangular pipe and casters are provided under the bottom wall, and further, by this structure when the apparatus main body is transported or moved, the caster 170 does not make direct influence of vibration or shock to the bottom wall 100, and the accuracy of the mainframe can be maintained.

Drum cartridge 30 is fixed to side wall 130 by inserting insertion member 30*a*, arranged at the end potion of drum cartridge 30, into insertion hole 131 of side section 130 of the mainframe and by inserting two positioning members 30*b*, formed on the inner side of insertion member 30*a*, into two positioning holes 132 bored on side section 130. Therefore, in the embodiment of the present invention, photoreceptor drum 31 is indirectly supported by side section 130 of the mainframe through insertion member 30*a*. In this structure, there is a possibility that drum cartridge 30 would be distorted by the torsion of side section 130, caused by the bending of the bottom section 100 having a low stiffness. This fact would deteriorate the relative positioning accuracies between photoreceptor drum 31, developing means 34 and cleaning means 38, resulting in a deterioration of the image quality of images formed in the image forming apparatus.

As will be described in the following, however, according to the bottom structure of bottom section 100 embodied in the present invention, it becomes possible to prevent bottom section 100 from bending and to maintain a good image quality.

The structure of the bottom wall 100 and the stay 150, embodied in the present invention, substantially comprises an upper surface, a lower surface and a side surface, which connect the upper surface and the lower surface. Namely, the above description means that, when the shapes of both the upper surface and the lower surface are rectangular, the structure is a rectangular parallelepiped, while, when the shapes of both the upper surface and the lower surface are circular, the structure is a cylindrical box. The meaning of "substantially comprises" in the above description is that holes, gaps or chips, residing on each surface due to manufacturing restrictions, are acceptable as far as a desired stiffness of the structure is maintained, though it is desirable that the bottom wall or the stay of the present invention is a box structure whose surfaces are perfectly covered by surfaces having neither holes, gaps nor chips. Concretely speaking, when outer surface area of the box structure, having neither holes, gaps nor chips, is defined as 100%, under a condition that the surfaces are covered 70%, more desirably 90%, of outer surface area of the box structure, the structure of the bottom wall 100 and the stay 150 embodied in the present invention, can maintain a sufficient stiffness. Further, the abovementioned box structure is a hollow box having inner room, and enables a sufficient stiffness with lightweight.

Figure 3:
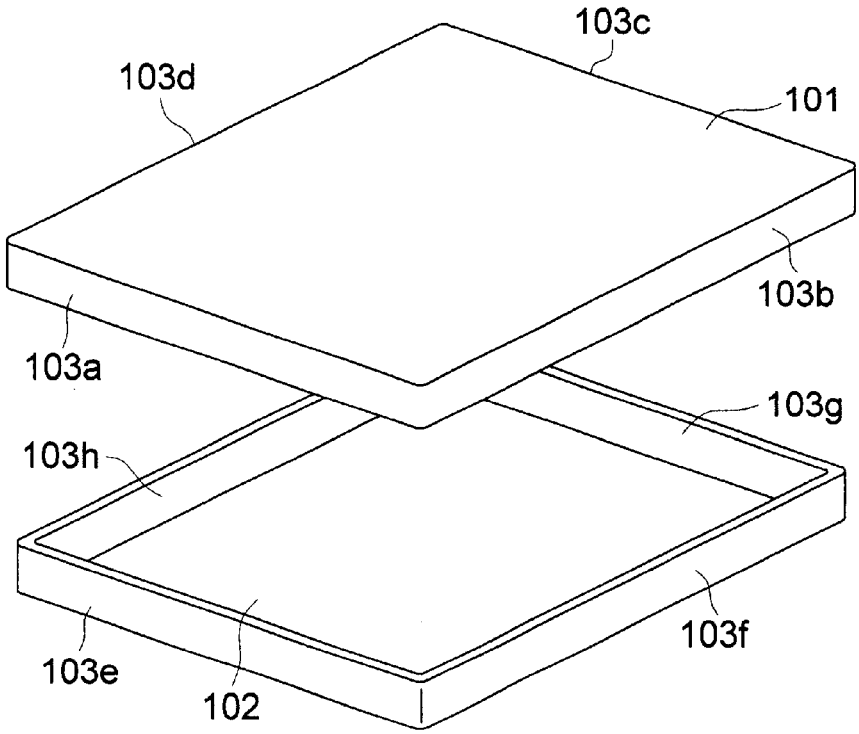
FIG. 3(*a*) and FIG. 3(*b*) show perspective views of the first exemplified structure of the bottom wall or the stay.
Figure 3:
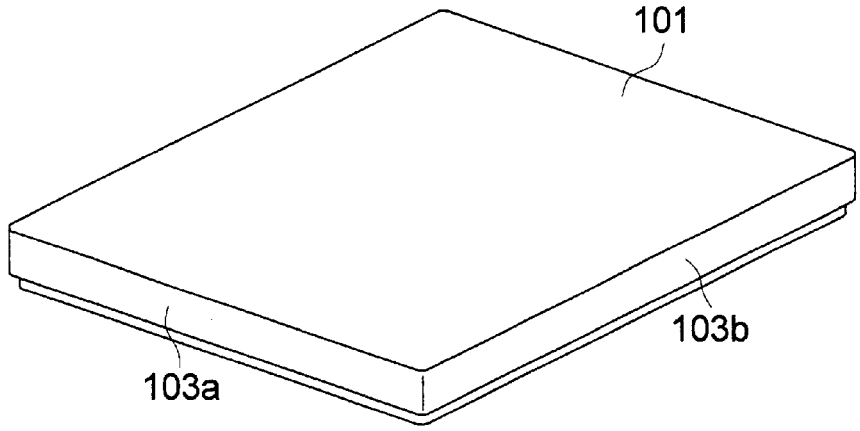

FIG. 3(*a*) and FIG. 3(*b*) show perspective views of an exemplified structure of a bottom wall or a stay embodied in the present invention. Two empty box-type members, each of which is formed by bending peripheral edge portions of a single metal sheet and faces each other, are put together to form the bottom wall or the stay to be flat-box type.

As shown in FIG. 3(*a*) and FIG. 3(*b*), the empty box-type upper member, which comprises upper surface 101 and side surfaces 103*a*, 103*b*, 103*c*, 103*d* connected to upper surface 101, is overlapped on the empty box-type lower member, which has a little smaller size and comprises lower surface 102 and side surfaces 103*e*, 103*f*, 103*g*, 103*h* connected to lower surface 102, and then, overlapped upper and lower side surfaces are either welded or adhered with adhesive to construct a flat box-type bottom wall or a stay.

Figure 4:
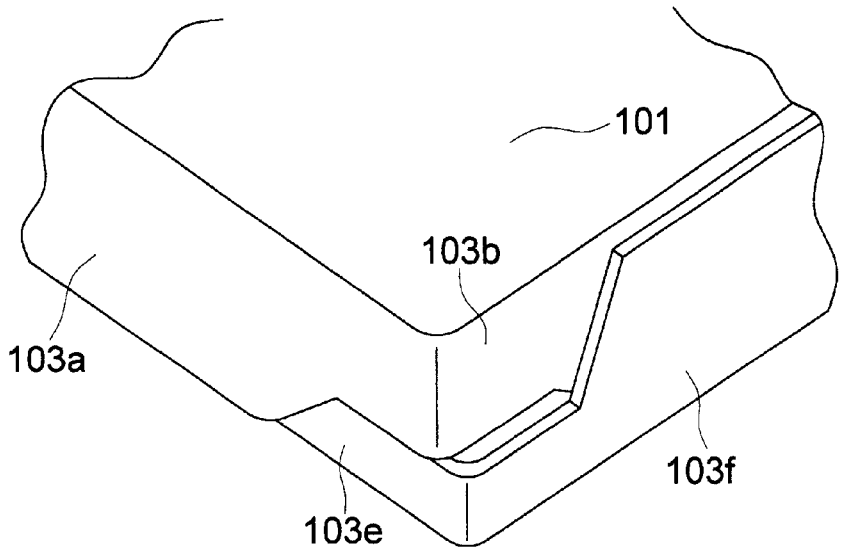
FIG. 4 shows an illustrative view of corner portion of the second exemplified structure of the bottom wall or the stay.
Figure 5:
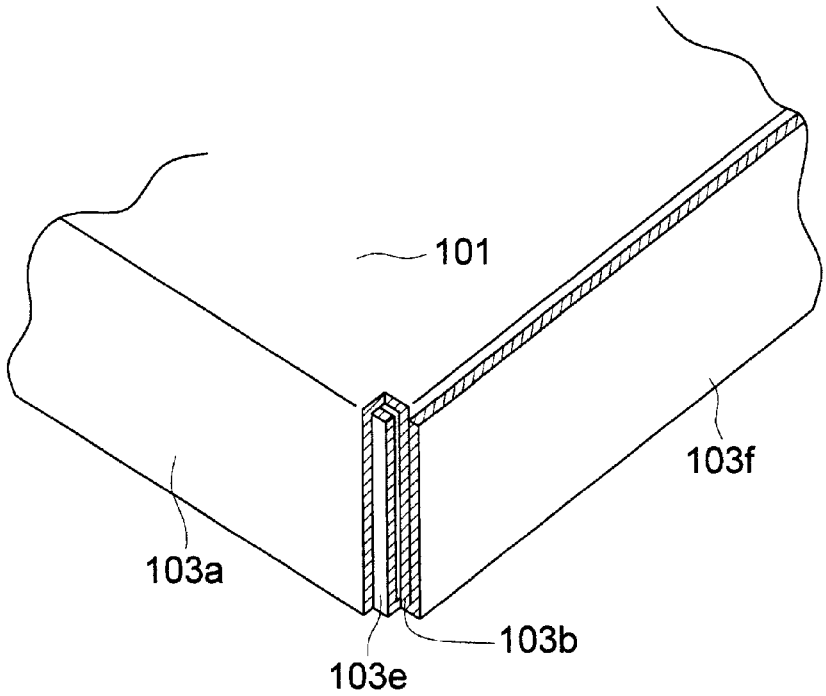
FIG. 5 shows an illustrative view of corner portion of the third exemplified structure of the bottom wall or the stay.

FIG. 4 and FIG. 5 are partially enlarged perspective views showing the corner portion of the bottom wall or the stay in the second and third embodiment of the present invention respectively.

In the embodiment shown in FIG. 4, two empty box-type upper and lower members, similar to those shown in FIG. 3(*a*), are put together. The corner of the pan-type upper member is the cross portion of side surfaces 103*a* and 103*b*, while the corner of the pan-type lower member is the cross portion of side surfaces 103*e* and 103*f*. The half height of each corner portion of two pan-type upper and lower members is cut away to combine them in stagger state. Then, overlapped upper and lower side surfaces are either welded or adhered with adhesive similar as the embodiment shown in FIG. 3(*b*). In the embodiment shown in FIG. 5, two empty box-type upper and lower members are also put together. The cross line portion of side surfaces 103*a* and 103*b*, and the cross line portion of side surfaces 103*e* and 103*f* are cut off, so that the pan-type upper and lower members fit each other to combine them in stagger state.

The bottom walls and the stays with structures shown in FIG. 3(*b*), FIG. 4, and FIG. 5 are preferable since they have higher stiffness due to double strengthened side surfaces, as well as they are easy for manufacturing.

The iron plate (SECC-C-20/20) can be preferably employed for material of the bottom wall and the stay. Bending amount $\delta$, to be described later, can be reduced by increasing the second moment of area, concretely, by increasing the height of the side section, which connect the upper surface and lower surface of the bottom wall or the stay, as much as possible. In addition, riveting method can be applied for fastening other members to the bottom wall or the stay.

FIG. 6(*a*) and FIG. 6(*b*) are illustrations showing the relations between the structure of the side wall in an image forming apparatus and its bending amount.

Figure 7:
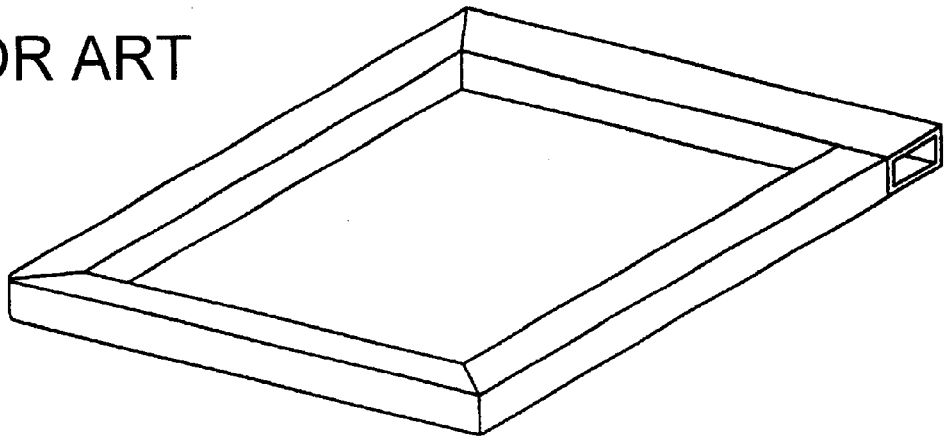
FIG. 7 PRIOR ART
FIG. 7 shows a perspective view of exemplified structure of the bottom wall in a conventional image forming apparatus.

FIG. 7 is a perspective view showing one type of embodiment of the bottom wall in a conventional image forming apparatus.

With respect to the bottom wall of a flat-box type structure shown in FIG. 3(*b*) and a conventional rectangular-pipe type structure shown in FIG. 7, bending amounts δ are evaluated and the evaluation results are shown as the graph in FIG. 6(*b*). Outer dimensions of each bottom wall structure are normalized as shown in FIG. 6(*a*).

A inch-size rectangular-pipe of 25 mm×50 mm, which is popular in the marketplace, is employed for the members of the rectangular-pipe type bottom wall. The material of the rectangular-pipe is STK (carbon steel tubes for structural purpose) and its thickness is 3.05 mm. The material of the flat-box type bottom wall is SECC-C-20/20, and its thickness is 1.6 mm. And both bottom wall structures are constructed by welding.

As shown in FIG. 6(*a*), bending amount δ, being under the evaluation, is defined as the vertical displacement (bending scale: mm) of the corner point of each bottom wall structure from the state with no load to the state with load W (kgf).

As is clear from the line graphs shown in FIG. 6(*b*), the bottom wall having a flat-box type structure, embodied in the present invention, exhibits approximately twice as much stiffness as the conventional rectangular-pipe type structure does.

Figure 8:
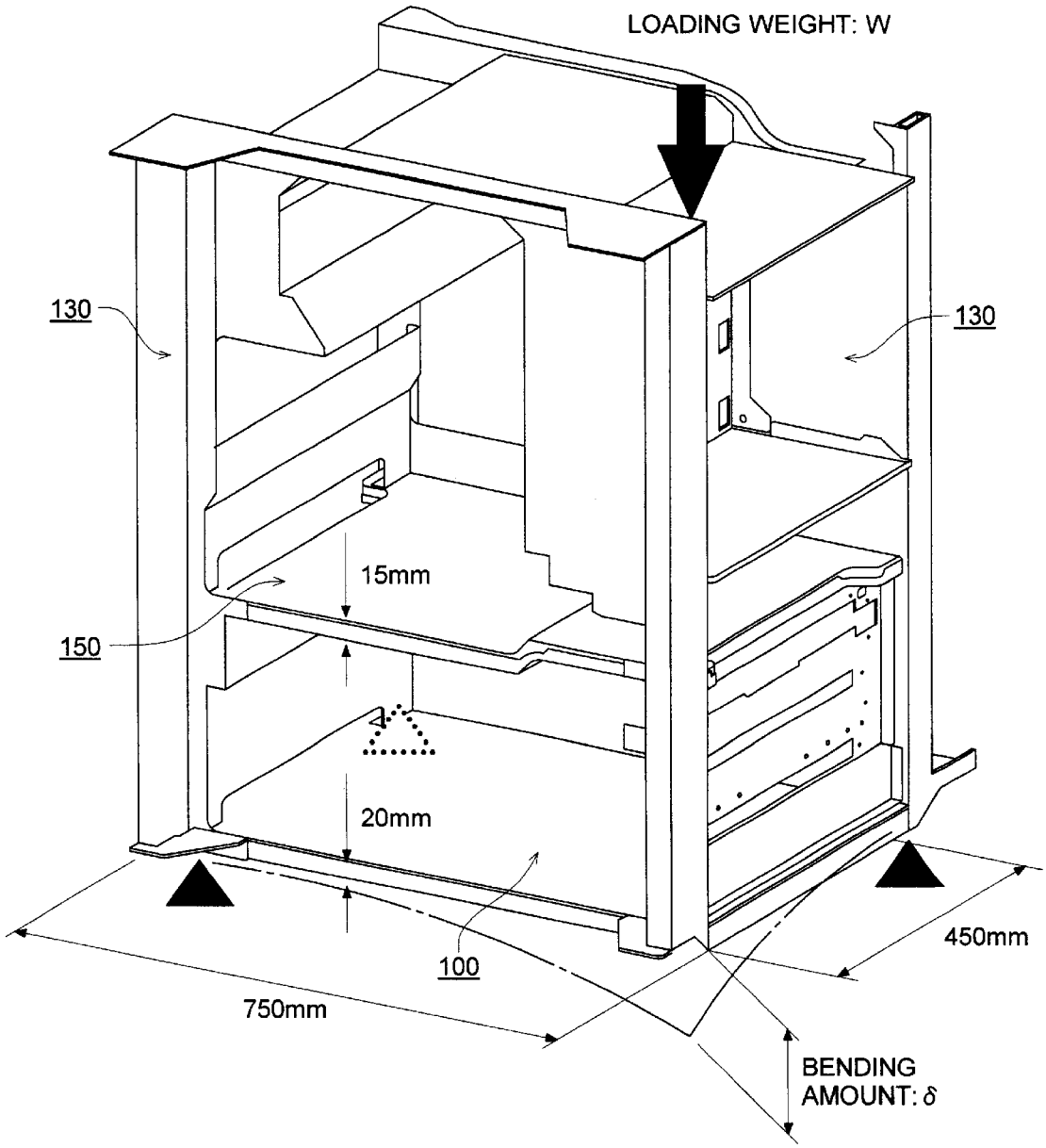
FIG. 8 shows a perspective view of the other structure of the image forming apparatus mainframe.

FIG. 8 shows another example of the embodiment in the present invention, a mainframe of an image forming apparatus comprising two opposed vertical side walls 130, one of which has a large cut portion, connected to be unified with a bottom wall 100 and a stay 150 provided in the manner of leaving space from the bottom wall. Wherein, the bottom wall 100 has a flat-box type structure in the size of 750 mm×450 mm×20 mm, and the thickness of the material plate is 1.6 mm, and the material is SECC-C-20/20. In regard to the following three types of structure of the stays, strength simulation was conducted for the mainframe of the image forming apparatus.

(1) A stay of flat-box type structure in the size of 750 mm×450 mm×15 mm, the thickness of the steel material plate (SECC-C-20/20) is 1.6 mm.

(2) A single plate in the size of 750 mm×450 mm, with the thickness of the steel material plate (SECC-C-20/20) is 1.6 mm.

(3) No stay is provided.

FIG. 9 shows the simulation result of the bending amount δ of the bottom wall at one corner, wherein three other corners of the bottom wall are supported as illustrated in FIG. 8, and a weight load W of 70 kgf is applied at the arrowed point in the upper portion of the mainframe.

From FIG. 9, it is clear that the bending amount of the mainframe provided with a flat-box type stay is considerably small compared to the mainframe with a single plate type stay, or the mainframe with no stay. This means that the mainframe provided with a flat box type stay has a high stiffness.

Incidentally, actual measurement has been conducted, separately from the above-described simulation, and approximately the same value of the vending amount δ has been measured.

As described above, according to the present invention, stiffness of the image forming apparatus mainframe is enhanced, maintaining a high image quality is possible, and an image forming apparatus with reduced height of main body can be provided.

What is claimed is:

1. An image forming apparatus comprising:

an image forming unit that forms an image on an image bearing member; and a mainframe that firmly supports and positions the image bearing member and the image forming unit, the mainframe comprising:

two side walls which are opposed to each other and substantially support the image bearing member and the image forming unit;

a bottom wall to which the two side walls are rigidly connected; and at least one stay which is rigidly connected to the two side walls in the manner of leaving space from the bottom wall, wherein each of the bottom wall and the at least one stay has a box type structure having an inner hollow room, and the box type structure comprises an upper surface, a lower surface and a side surface, through which the upper surface and the lower surface are connected with each other.

2. The image forming apparatus of claim 1, wherein the box type structure is structured by connecting an upper empty box and a lower empty box each of which is formed by bending a peripheral edge portion of a single metal sheet.

3. The image forming apparatus of claim 2, wherein the upper empty box and the lower empty box are connected to each other by welding.

4. The image forming apparatus of claim 1 wherein the bottom wall, the sidewall and the at least one stay are connected to each other by welding.

5. The image forming apparatus of claim 1, wherein the box type structure is in a shape of a rectangular parallelepiped.

6. The image forming apparatus of claim 1 wherein a caster is provided on each of the two side walls in such a manner that the top portion of the caster positions at a higher level than the under surface of the bottom wall.

* * * * *